United States Patent [19]

Hildebrand

[11] Patent Number: 4,493,658

[45] Date of Patent: Jan. 15, 1985

[54] PADDLE BOAT

[75] Inventor: Clifford F. Hildebrand, Peterson, Minn.

[73] Assignee: Dean C. Hidebran, Sacramento, Calif.

[21] Appl. No.: 450,335

[22] Filed: Dec. 16, 1982

[51] Int. Cl.[3] ..... B63H 16/12

[52] U.S. Cl. ..... 440/30; 114/61; 440/90

[58] Field of Search ..... 114/61, 357; 440/21, 440/26, 27, 29, 30, 90

[56] References Cited

U.S. PATENT DOCUMENTS

| | | | |
|---|---|---|---|
| 1,320,540 | 11/1919 | Fedzyna | 440/30 |
| 3,426,716 | 2/1969 | Hackworth | 114/61 |
| 3,790,977 | 2/1974 | Bombardier et al. | 114/357 |

FOREIGN PATENT DOCUMENTS

| | | | |
|---|---|---|---|
| 413350 | 4/1946 | Italy | 440/21 |
| 23706 | 11/1904 | United Kingdom | 440/90 |
| 674211 | 6/1952 | United Kingdom | 115/23 |

*Primary Examiner*—Sherman D. Basinger
*Attorney, Agent, or Firm*—Mark C. Jacobs

[57] ABSTRACT

A paddle boat having a steerable rudder, a seat, a chain driven pedal actuated paddle assembly and storage areas above deck associated with the seat and wheel housings. The paddles can be either synchronized or unsynchronized so that both paddles are either in the water at the same time or one paddle trails out of the water while the other paddle is in the water.

7 Claims, 8 Drawing Figures

PADDLE BOAT

BACKGROUND OF THE INVENTION

1. Field of the Invention

The invention relates to paddle boats; and, more particularly, to a paddle boat having a chain driven pedal actuated paddle assembly and improved storage on the boat.

2. Description of the Prior Art

Paddle boats are well known in the art and have given much enjoyment over the years. Generally, such boats are pedal actuated and move either forwardly or rearwardly or left to right. A pedal drive for a watercycle is disclosed in U.S. Pat. No. 2,824,539 to Budney et al. A water wheel, however, is actuated by the pedals. In U.S. Pat. No. 3,083,677 to Deubelbeiss, a paddle boat is disclosed driven by a pedal actuated chain drive. The paddle blades are substantially linear in cross-section (FIG. 6) and no storage is provided. Similar paddle blades are shown in U.S. Pat. No. 3,143,992 to Beams and no above deck storage is provided. Flat paddles are also shown in U.S. Pat. No. 4,318,700 to Price and none of these prior art patents show a paddle boat with an elevated seat with storage therein above deck and a conventional steering wheel.

There is thus a need for a paddle boat having improved pedal-actuated paddle blades, storage above deck associated with an elevated seat and a steering wheel for steering the rudder.

SUMMARY OF THE INVENTION

It is an object of this invention to provide an improved paddle boat having pedal-actuated paddle blades.

It is a further object of this invention to provide a paddle boat having an elevated seat with above deck storage therein and a steering wheel for turning the rudder thereof.

It is still another object of this invention to provide an improved paddle boat having blades that are arcuate in cross-section and may be set for either synchronous or unsynchronous operation.

These and other objects are preferably accomplished by providing a paddle boat having a steerable rudder, a seat, a chain driven pedal actuated paddle assembly and storage areas above deck associated with the seat and wheel housings. The paddles may be either synchronized or unsynchronized so that both paddles are either in the water at the same time or one paddle trails out of the water while the other paddle is in the water. The paddle blades may also be arcuate in cross-section.

DESCRIPTION OF THE PREFERRED EMBODIMENT

Figure 1:
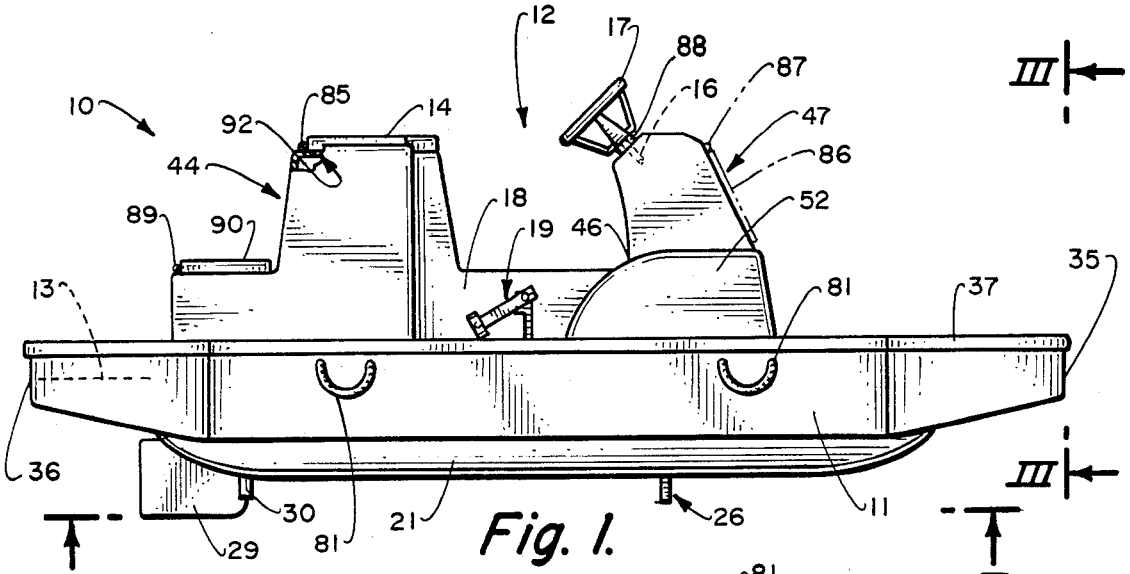
FIG. 1 is a vertical view of the paddle boat of the invention.

Referring now to FIG. 1 of the drawing, a paddle boat 10 is shown having a hull 11 and a housing 12 mounted on deck 13. Housing 12 is comprised of a seat portion 14, a steering column portion 15 and a pedal assembly portion 18. A wheel shaft 16 extends upwardly through and rearwardly from column portion 15 and includes a steering wheel 17 fixedly and removably secured at its outer extremity as by a set screw or the like. A pedal assembly 19 is mounted in pedal assembly housing portion 18 and will be discussed further in detail hereinbelow.

Figure 2:
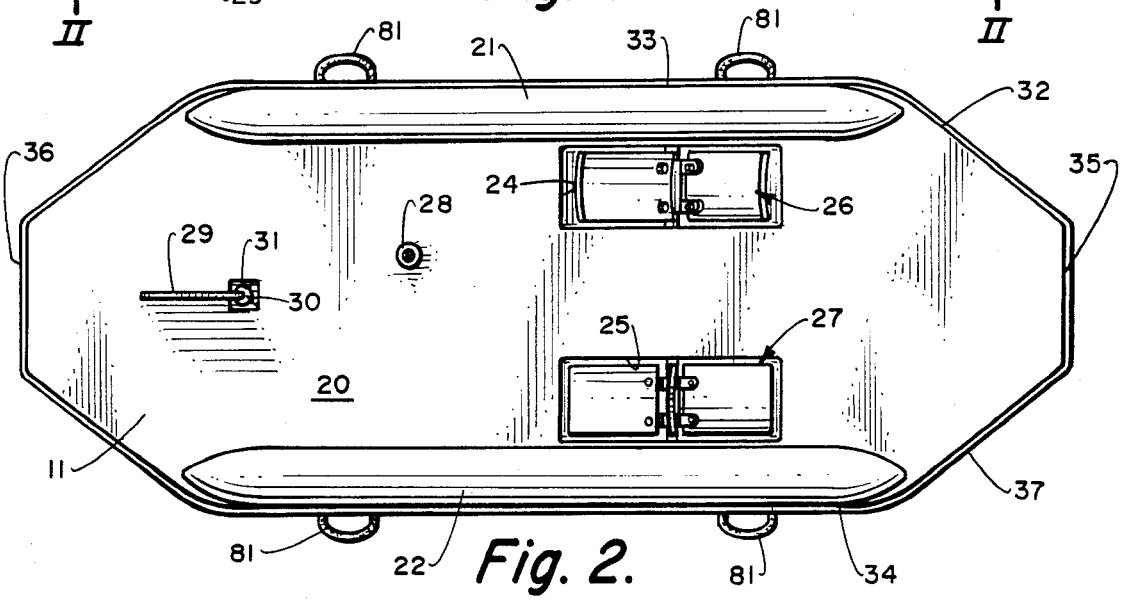
FIG. 2 is a bottom plan view of the boat of FIG. 1 taken along lines II—II thereof.
Figure 3:
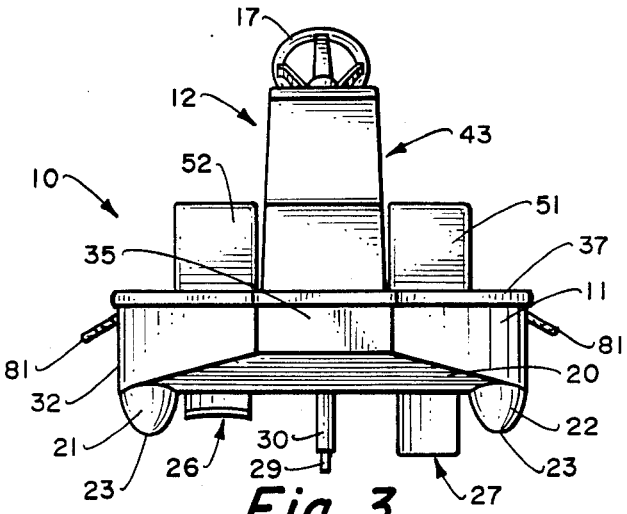
FIG. 3 is a view taken along lines III—III of FIG. 1.

As seen in FIG. 2, the bottom 20 of hull 11 includes a pair of spaced parallel pontoons 21,22 (see also FIG. 3) along the longitudinal sides thereof having rounded edges 23 (FIG. 3). Hull 11 also includes a pair of spaced cut-out areas 24,25 through which paddle blade assemblies 26,27, respectively, extend. An optionally capped drain hole 28 is also provided and a steerable rudder 29 is attached to a shaft 30 extending through a hole 31 in hull bottom 20.

It can also be seen in FIG. 2 that the outer peripheral edge 32 is comprised of the sides curving at the back and front to flat front and back sections 35,36, respectively. A cushioning rail 37, such as rubber, runs along the top peripheral portion of edge 32 as shown.

Figure 4:
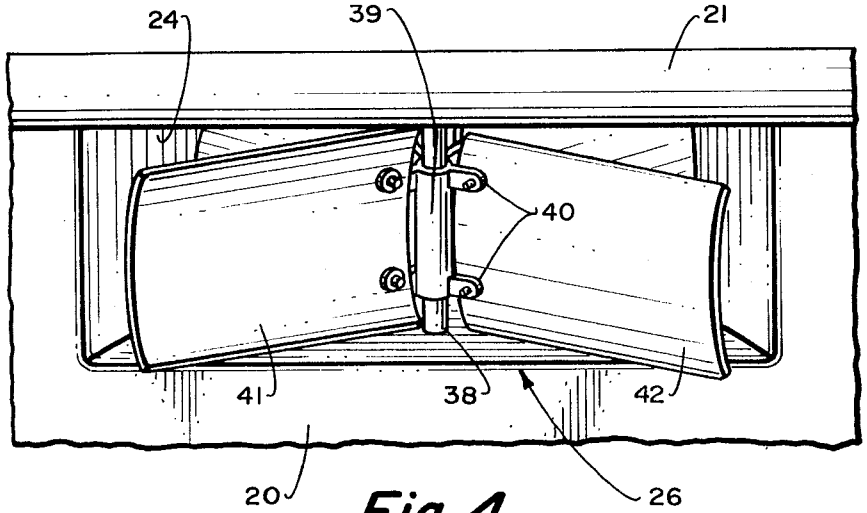
FIG. 4 is a detailed view of a portion of the bottom of the boat as seen in FIG. 2.

As shown in FIG. 4, each paddle blade assembly 26,27, such as assembly 26, includes a shaft 38 fixedly mounted in its respective cut-out area, such as area 24, and a collar 39 rotatably mounted on shaft 38 having a pair of flanges 40 fixedly secured to a pair of oppositely and angularly extending paddle blades 41,42. Although only two blades are visible, obviously more than two, such as four spaced about 90 degrees apart may be provided in each paddle assembly.

Figure 5:
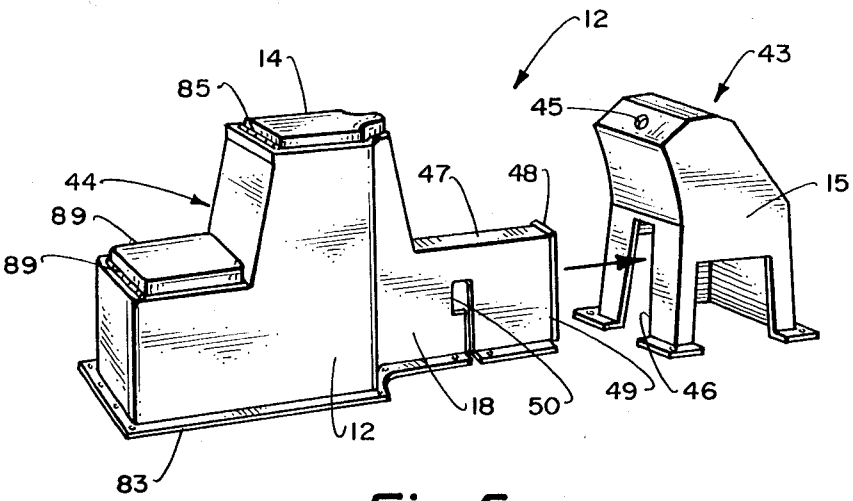
FIG. 5 is a perspective view of two components of the housing above deck of the boat of FIG. 1.

Although housing 12 may be assembled onto hull 11 in any suitable manner as shown in FIG. 5, housing 12 is preferably comprised of two sections 43,44. Section 43 includes the steering column portion 15 with opening 45 at the top for receiving wheel shaft 16 (FIG. 6) therethrough. Section 43 also has a hollow slotted lower section 46 therein.

Section 44 includes an elongated tongue 47 adapted to abut against section 46 as shown in FIG. 1. A rubber grommet 48 extends about the terminal peripheral end of tongue 47 fitting about the periphery of slot 49 to form a fluid tight seal. Pedal assembly portion 18 is of course provided in tongue 47 with opening 50 therein for receiving the pedal assembly as will be discussed. Seat portion 14 is of course provided on top rearwardly of tongue 47 and may be cushioned and contoured as shown.

As shown in FIG. 1 (see also FIGS. 6 and 7), a pair of spaced paddle blade housings 51,52 are provided on the upper surface of deck 13. It is to be understood that housings 51,52 straddle openings 24,25 respectively (FIG. 2). The slotted section 46 of housing section 43 fits between housings 51,52 as shown in FIG. 1.

Figure 7:
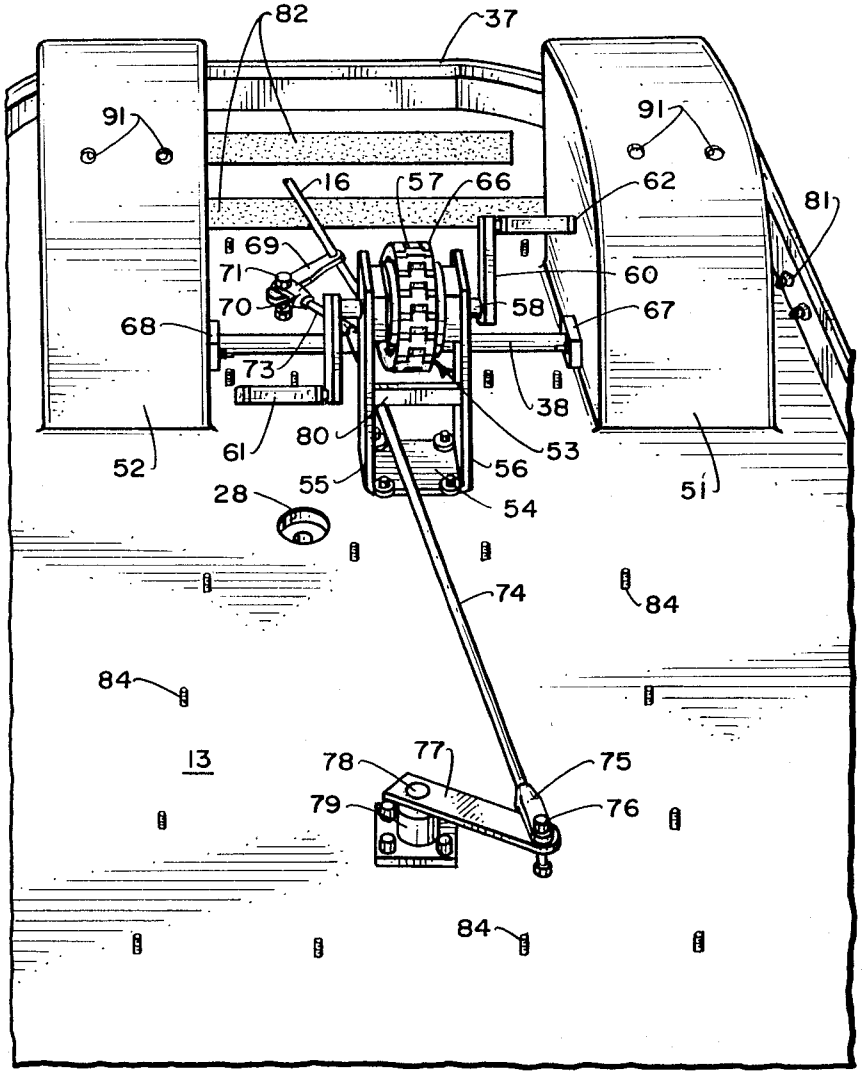
FIG. 7 is a view similar to FIG. 6 from the rear of the boat.
Figure 6:
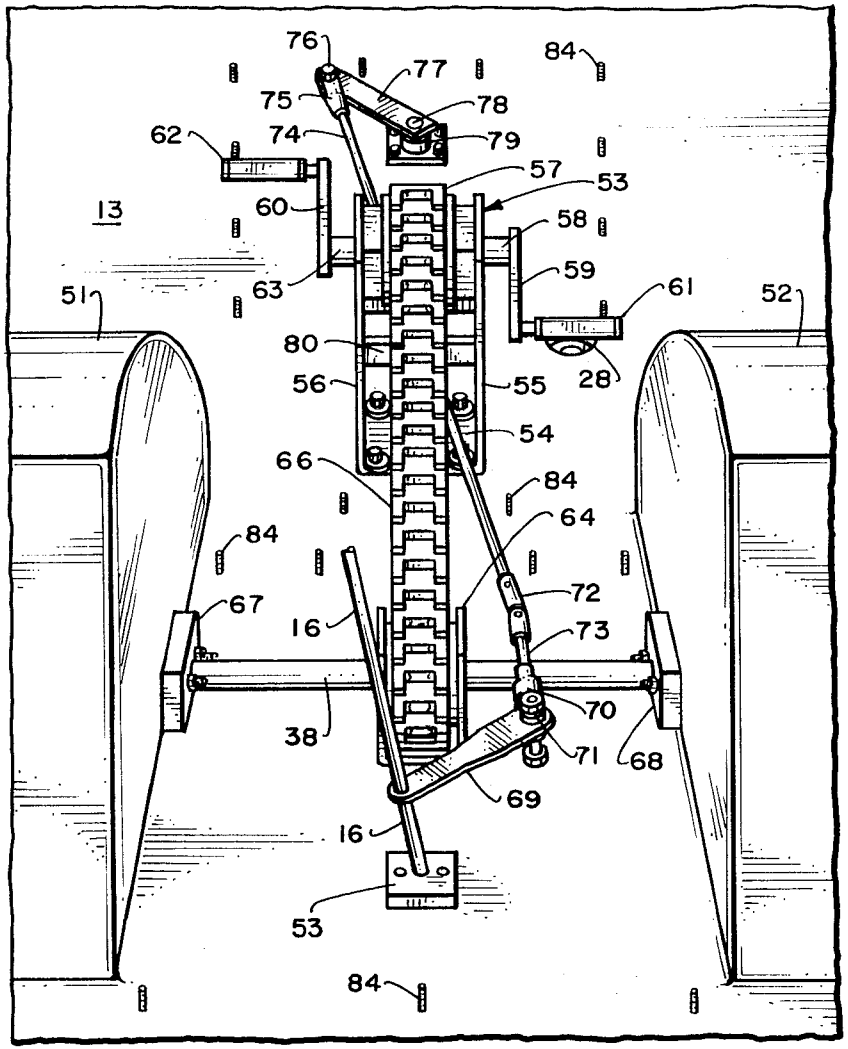
FIG. 6 is a perspective view of the pedal assembly of the boat of FIG. 1 from the front thereof with the housing removed.

The steering mechanism for boat 10 will now be described. Referring particularly to FIGS. 6 and 7, the steering mechanism includes aforementioned wheel shaft 16 rotatable in a bearing assembly 53 mounted on deck 13 and having wheel 17 connected at the top. Rotation of wheel 17 thus rotates shaft 16. A flange plate 54 is also mounted on deck 13 rearwardly of housings 51,52 (FIG. 7) and includes a pair of spaced upstanding vertical plates 55,56. A sprocket drum 57 is fixedly mounted on shaft 58 between the upper ends of flange plates 55,56. A pair of pedal arms 59,60 are fixedly secured to the free ends of shaft 58 on each opposite outside of flange plates 55,56, as shown.

Foot pedals 61,62 are fixedly and removably secured, as by allen screws, to the free ends of pedal arms 59,60, respectively, and, as seen in FIG. 1, arms 59,60 and their respective pedals 61,62 are accessible on the outside of boat 10. The pedal shaft 63 extends out of opening 50 (FIG. 5).

A second sprocket drum 64 (FIGS. 6 and 7) is fixedly mounted on the rotatable shaft 38 (see also FIG. 4) journalled for rotation between housings 51,52 below and forwardly of drum 64 in suitable bearing assemblies 67,68, respectively. An endless chain 66 engages both sprocket drums 57 and 64 as shown, It is to be understood that pedalling pedals 61,62 rotates shaft 38 and thus the paddle blades assemblies 26,27. Reversing the direction of pedal rotation also obviously reverses the paddle direction so the boat 10 can go either forwardly or rearwardly.

The means for operating rudder 29 will now be described again referring particularly to FIGS. 6 and 7.

As seen in FIGS. 6 and 7, a link 69 is fixedly secured to the lower end of wheel shaft 16. A clevis pin 70 is pivotally attached to the free end of link 69 by a suitable nut and bolt 71. A universal joint 72 is coupled to pin 70 via shaft 73 and an elongated shaft 74 extends from joint 72 (see particularly FIG. 7) between flanges 55,56 to a second clevis pin 75. Pin 75 is pivotally connected, via nut and bolt 76, to a link 77 having its free end fixedly secured to the top 78 of rudder shaft 30. The top 78 of shaft 30 is rotatable in a bearing assembly 79 mounted on the upper surface of deck 13 as shown. Also, as shown in FIG. 7, a spacer bar 80 is provided between flanges 55,56 above shaft 74 so as to prevent engagement of shaft 74 and chain 66. It can be appreciated that rotation of wheel 17 moves link 69 to thereby rotate rudder shaft 30 and move rudder 29 (FIG. 2). Of course, the wheel 17 can be rotated clockwise or counterclockwise to move rudder 29 accordingly.

Figure 8:
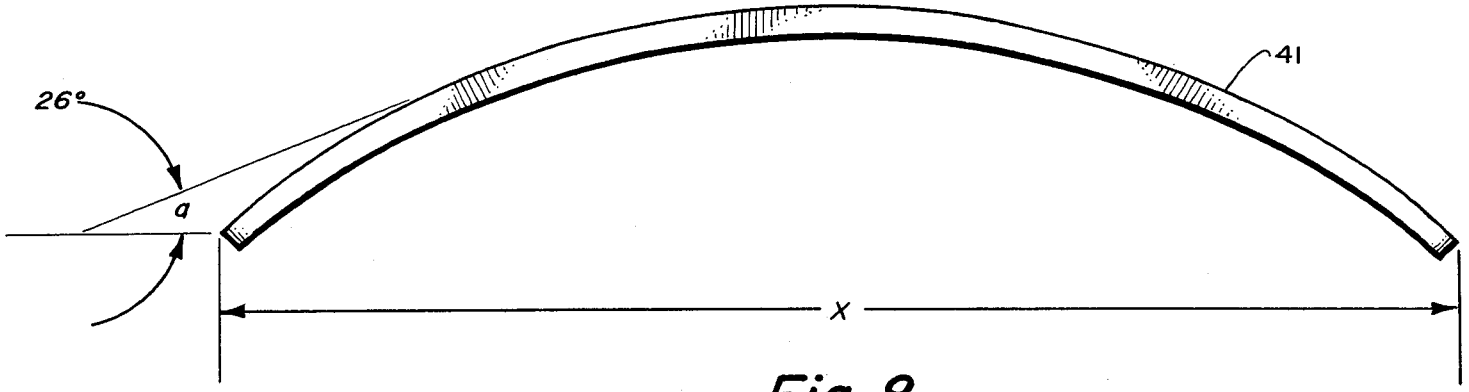
FIG. 8 is an end view of one of the paddle blades shown in FIG. 4.

If desired, as shown in FIG. 1, flexible hand grips such as ropes 81 may be fixed to hull 11 about the periphery thereof. Also, as seen in FIGS. 6 and 7, one or more spaced skid preventing strips 82 may be provided on the upper surface of deck 13. Alternately a molded anti-skid pattern may be employed on the deck surface, such as a cross hatch configuration. As shown in FIG. 1, the lower edges of sections 43,44 may terminate in suitable apertured flanges 83 adapted to receive bolts therethrough for fixedly securing sections 43,44 in position on deck 13. These bolts 84 can be seen in FIGS. 6 and 7 and may be fixed in position and aligned with the apertures in flanges 83. As shown in FIG. 8, each paddle blade, such as blade 41, may be curved in cross-section and of any suitable material, such as plastic, and any suitable length. For example, the space x in FIG. 8 may be about 8" and the angle a about 26°. The blades may be about ¼ inch thick and about 12" long or longer.

The hull 11 may be of any suitable dimensions, such as an overall length of about 10 feet and an overall width of about 4 feet. Any suitable number of drain holes may be provided and their locations may vary. Various vent holes may be provided. Pontoons 21,22 may be filled with a suitable structural foamed polymeric material as well as all or a portion of the hull 11 (which may otherwise be hollow) as, for example, the bottom 3–6 inches thereof. The bow and stern of hull 11 may be of a vertical height higher than the center around the perimeter thereof, such as 2 inches, to prevent water from shipping over the edges when an abnormal load is on the deck 13 at the bow or stern.

The seat 14 may be hinged, via hinge 85 (FIG. 1) at the rear thereof to provide access to the hollow interior of seat portion 14 for storage or the like. Also, a hinged door 86 (FIG. 1) hingedly attached via hinge 87 to the forward end of steering column portion 15 may also be provided to provide access to the hollow interior thereof for storage.

The shaft 16 may be keyed to the top of the steering column portion 15, as by keying the shaft 16 to collar 88 (FIG. 1) through which shaft 16 extends preventing withdrawal of shaft 16 from bearing assembly 53.

If desired, additional access to the interior of the seat portion 14 of housing 12 may be provided by a liftable partition 90 (FIG. 1) hingedly attached at hinge 89 to seat portion 14.

Rudder 29 may also be of any suitable dimensions and material, such as ¼ inch thick plastic and about 8 and ½ inches wide and about 12 inches long.

As heretofore discussed, the paddle blades rotate in housings 51,52. As shown in FIG. 7, one or more apertures 91 may be provided in the top rear surface of each housing 51,52 to prevent vacuum buildups due to fast pedalling followed by cessation of pedalling.

The hull 11 may be of molded plastic and assembled in any suitable manner, such as two sections pop riveted together at spaced intervals. Rubber channeling may be used between the sections with the rivets passing through the channelling to prevent pull out and conceal the interface. The channeling, howver, may also hide the rivets or other suitable fasteners, Silicone caulking may be used at the junction of the sections.

The paddle blades 41,42 may be set to rotate either synchronized or unsynchronized by merely changing the orientation of the collar 39 on the shaft 38 (the collars may be keyed to the shaft, as by allen screws or the like). That is, both paddles may move in the water simultaneously or one paddle could be in the water while the other trailed out of the water.

It can be seen that there is disclosed an easily manufactured and assembled paddle boat which is efficient and much improved over prior art paddle boats.

For added safety a grab bar can be placed on both sides of housing 12 as at 92; in FIG. 1.

To increase buoyance preferrably foamed in place urethene or styrene may be employed in the pontoons and/or a portion of the hull. Especially since the hull 11 which while manufactured in two parts includes the desk 13 as one of the parts.

Since certain changes may be made in the above apparatus and method without departing from the scope of the invention herein involved, it is intended that all matter contained in the above description and shown in the accompanying drawings shall be interpreted as illustrative and not in a limiting sense.

I claim:

1. In a foot pedal actuated paddle boat having a hull, a deck, a pair of longitudinal buoyant pontoons, one on each side of the bottom of the hull, a pair of spaced paddle blade housings in the hull having similar paddle blades therein, a rudder, the improvement comprising:

a driver's seat elevated from said deck and mounted upon a storage compartment disposed upon said deck, a single set of pedals coupled to said blades for rotating same by a chain driven rotatable shaft having a pair of spaced hubs fixedly mounted thereon for rotation therewith in said paddle blade housings, each of said hubs having a plurality of paddle blades fixedly secured thereto rotatable in each of said paddle blade housings, the paddle blade housings being disposed forward of said seat, a steering wheel disposed in front of said seat operably connected to said rudder for rotating same, said paddle blade housings including apertures therethrough at the top thereof, rearwardly of the front of said boat for preventing vacuum buildup due to excessive pedalling followed by cessation of pedalling, and wherein each paddle blade is arcuate in the lateral cross-section, and wherein the radial orientation of said blades on one hub are non-synchronized with the radial orientation of the blades extending from the other hub whereby when one set of blades is in the water during operation of the boat, the other set of blades trail out of the water.

2. In the boat of claim 1 wherein said steering wheel extends from a steering wheel housing having an above deck storage compartment therein.

3. In the boat of claim 1 wherein the buoyant pontoons are filled with structural foam.

4. In the boat of claim 1 wherein the plurality of blades comprises at least three blades evenly spaced apart mounted on each hub.

5. In a front pedal activated paddle boat having a hull, a pair of longitudinal buoyant pontoons one on each side of the bottom of the hull, a deck, a pair of spaced paddle blade housings in the hull, at least a pair of arcuate in cross-section paddle blades journaled for rotation in said paddle blade housings, chain drive pedals coupled to said blades to rotate same, a rudder coupled to and controlled by a steering wheel, said paddle blade housings including apertures therein adapted to prevent vacuum buildup in said housings and the radial orientation of said blades of one hub are non-synchronized relative to the blades of the other hub.

6. In the boat of claim 5 wherein the buoyant pontoons are filled with a structural foam to increase buoyancy.

7. In the boat of claim 6 wherein a portion of the hull is filled with structural foam, and further including storage compartments mounted on said hull above said deck.

* * * * *